US011268708B2

(12) United States Patent
Qiu et al.

(10) Patent No.: US 11,268,708 B2
(45) Date of Patent: Mar. 8, 2022

(54) OUTDOOR UNIT FOR CENTRAL AIR CONDITIONER AND CENTRAL AIR CONDITIONER HAVING SAME

(71) Applicants: GD MIDEA HEATING & VENTILATING EQUIPMENT CO., LTD., Foshan (CN); MIDEA GROUP CO., LTD., Foshan (CN)

(72) Inventors: Shilin Qiu, Foshan (CN); Junfei He, Foshan (CN); Jian Liao, Foshan (CN); Yang Li, Foshan (CN); Guangpei Chu, Foshan (CN)

(73) Assignees: GD MIDEA HEATING & VENTILATING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 143 days.

(21) Appl. No.: 16/627,857

(22) PCT Filed: Dec. 28, 2018

(86) PCT No.: PCT/CN2018/124909
§ 371 (c)(1),
(2) Date: Dec. 31, 2019

(87) PCT Pub. No.: WO2019/141068
PCT Pub. Date: Jul. 25, 2019

(65) Prior Publication Data

US 2020/0124297 A1 Apr. 23, 2020

(30) Foreign Application Priority Data

Jan. 16, 2018 (CN) ..... 201820075560.7

(51) Int. Cl.
*F25D 23/12* (2006.01)
*F24F 1/38* (2011.01)
*F24F 1/56* (2011.01)

(52) U.S. Cl.
CPC . *F24F 1/38* (2013.01); *F24F 1/56* (2013.01)

(58) Field of Classification Search
CPC ..... F24F 1/38; F24F 1/50; F24F 1/56; F24F 13/20; E05D 7/10
See application file for complete search history.

(56) References Cited

U.S. PATENT DOCUMENTS

2019/0040665 A1* 2/2019 Jean ..... E05D 11/082
2019/0072285 A1* 3/2019 Morikawa ..... F24F 1/50

FOREIGN PATENT DOCUMENTS

CN 101586838 A * 11/2009 ..... F24F 1/00
CN 101586838 A 11/2009

(Continued)

OTHER PUBLICATIONS

The attached pdf is the translation of foreign reference CN 101586838 A. (Year: 2009).*

(Continued)

*Primary Examiner* — Henry T Crenshaw
*Assistant Examiner* — Kamran Tavakoldavani
(74) *Attorney, Agent, or Firm* — Dilworth & Barrese, LLP.; Michael J. Musella, Esq.

(57) ABSTRACT

An outdoor unit for a central air conditioner and a central air conditioner having the same are provided. The outdoor unit includes a unit body and at least One panel. One side of the unit body is open, and the panel is arranged on the side of the unit body to open and close the unit body. One end of the panel is pivotally and detachably connected to the unit body through a pivot structure. The pivot structure includes a base provided on the unit body and a pivot seat provided on the (Continued)

panel. A top of the base has a pivot shaft spaced apart from the unit body and extending upward, and the pivot seat is provided with a pivot hole having an open bottom and configured to be detachably fitted with the pivot shaft.

19 Claims, 5 Drawing Sheets

(56) References Cited

FOREIGN PATENT DOCUMENTS

| | | | |
|---|---|---|---|
| CN | 201635555 | U | 11/2010 |
| CN | 204002199 | U | 12/2014 |
| CN | 204084673 | U | 1/2015 |
| CN | 205908173 | U | 1/2017 |
| CN | 207922420 | U | 9/2018 |
| JP | 3080216 | U | 9/2001 |

OTHER PUBLICATIONS

International Search Report and Written Opinion dated Mar. 18, 2019 from State Intellectual Property Office of the P.R. China.

* cited by examiner

OUTDOOR UNIT FOR CENTRAL AIR CONDITIONER AND CENTRAL AIR CONDITIONER HAVING SAME

CROSS-REFERENCE TO RELATED APPLICATIONS

The present disclosure is a national stage filing of international application PCT/CN2018/124909, filed on Dec. 28, 2018, the entire contents of each or which are incorporated herein by reference.

FIELD

The present disclosure relates to a field of air conditioner manufacturing technology, and more particularly to an outdoor unit for a central air conditioner and a central air conditioner having the outdoor unit.

BACKGROUND

A central air conditioner usually includes an outdoor unit and an indoor unit. The outdoor unit is provided with a compressor, a gas-liquid separator, an oil separator and other structures. In related art, a panel of the outdoor unit is basically fixed by bolts, and the number of bolts is large. During maintenance, firstly, the bolts used to fix the panel need to be removed, and then the panel can be removed to carry out internal maintenance of the machine. Moreover, since the panel itself is heavy, the operation is very time-consuming and inconvenient. For installers and repairers in some developed countries or regions where labor costs are high, this is also a significant expenditure.

SUMMARY

The present disclosure seeks to solve at least one of the technical problems existing in the related art. Hence, the present disclosure proposes an outdoor unit for a central air conditioner, which is convenient to operate and time-saving when the outdoor unit is repaired and maintained.

The present disclosure also proposes a central air conditioner having the above outdoor unit.

According to embodiments of a first aspect of the present disclosure, the outdoor unit includes: a unit body; and at least one panel provided on the unit body to open and close the unit body, wherein an end of the panel is pivotally and detachably connected with the unit body through a pivot structure, the pivot structure includes a base provided on the unit body and a pivot seat provided on the panel, a top of the base has a pivot shaft spaced apart from the unit body and extending upward, and the pivot seat is provided with a pivot hole having an open bottom and configured to be detachably fitted with the pivot shaft.

For the outdoor unit according to embodiments of the present disclosure, by pivotally and detachably connecting the panel to the unit body through the above pivot structure, the operation is convenient and time-saving when the outdoor unit is repaired and maintained, thereby reducing the cost of manual maintenance or repair.

According to some embodiments of the present disclosure, a cross-sectional area of the base is larger than a cross-sectional area of the pivot shaft.

According to some embodiments of the present disclosure, a cross-sectional area of a top end of the pivot shaft increases gradually from up to down.

According to some embodiments of the present disclosure, a front side of the unit body is open, and the panel is arranged at the front side of the unit body; the unit body includes two side walls spaced apart from each other in a left-right direction and a rear wall connected between rear ends of the two side walls; a front end of at least one of the two side walls has an extended wall that is parallel to the rear wall and extends towards a center of the unit body; the base is arranged on a front surface of the extended wall and is located on a side adjacent to the center of the unit body; a front surface of the panel has a mounting surface for arranging the pivot seat; the mounting surface is located on an end of the panel adjacent to the at least one of the two side walls, and the mounting surface obliquely extends backward from the center of the unit body to a side where the at least one of the two side walls is located.

According to some embodiments of the present disclosure, the front surface of the panel protrudes beyond the front surface of the extended wall.

According to some embodiments of the present disclosure, the pivot seat includes a pivot base provided on the mounting surface and a pivot body which is provided on a side of the pivot base adjacent to the extended wall and which is spaced from the panel; a pivot hole is formed in the pivot body, and a top surface of the pivot body is flush with a top surface of the pivot base.

According to some embodiments of the present disclosure, the panel is pivotally connected with the unit body through two pivot structures spaced apart from each other in an up-down direction.

According to some embodiments of the present disclosure, the panel is provided with a handle portion.

According to some embodiments of the present disclosure, the handle portion is formed by a part of a side surface of the panel away from a center of the unit body being recessed towards the center of the unit body.

According to some embodiments of the present disclosure, two panels are provided and arranged opposite to and spaced apart from each other.

The central air conditioner according to embodiments of a second aspect of the present disclosure includes the outdoor unit according to the embodiments of the above first aspect of the present disclosure.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and readily appreciated from the following descriptions made with reference to the drawings.

REFERENCE NUMERALS

Figure 1:
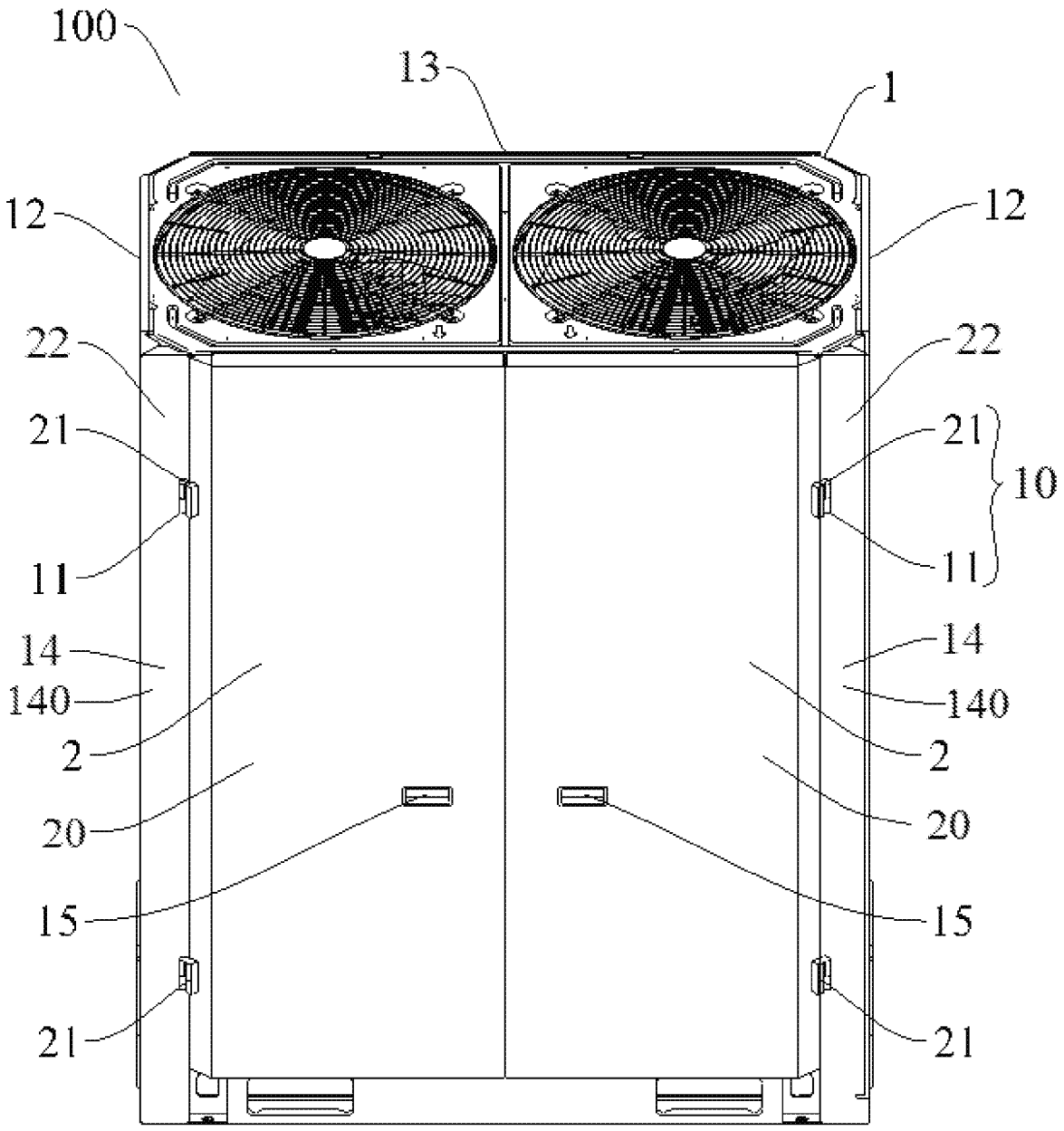
FIG. 1 is a perspective view of an outdoor unit for a central air conditioner according to an embodiment of the present disclosure, wherein a unit body is closed by a panel.
Figure 2:
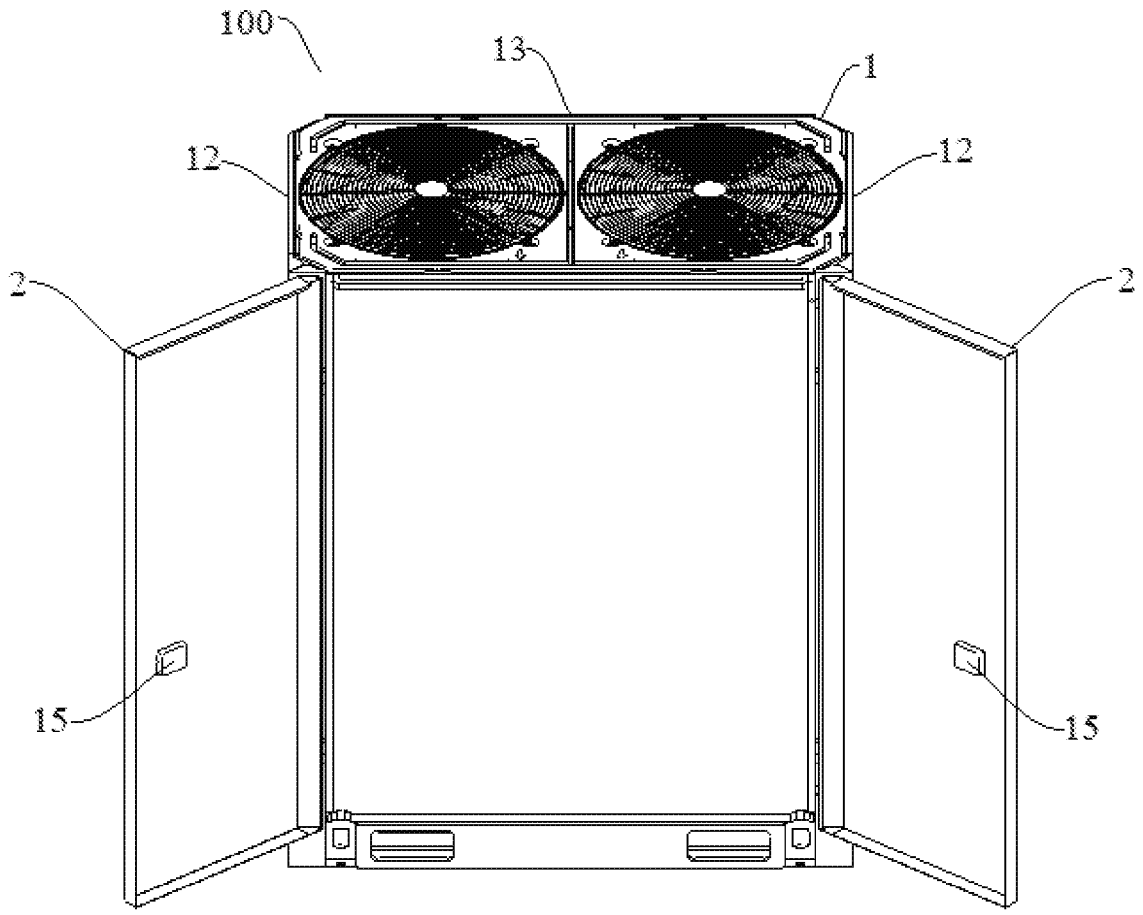
FIG. 2 is another perspective view of an outdoor unit for a central air conditioner according to an embodiment of the present disclosure, wherein a left panel and a right panel are both in an open state.

200: central air conditioner;
100: outdoor unit for central air conditioner,
1: unit body; 10: pivot structure; 11: base; 111: pivot shaft;
12: side wall; 13: rear wall;
14: extended wall; 140: front surface of extended wall; 15: handle portion;
2: panel; 20: front surface of panel; 21: pivot seat; 211: pivot base; 212: pivot body; pivot hole 2121;
22: mounting surface.

DETAILED DESCRIPTION

Embodiments of the present disclosure are further described. Examples of the embodiments are illustrated in the accompanying drawings. Same or similar reference signs represent the same or similar components or components that have the same or similar functions from beginning to end. The embodiments described below with reference to the accompanying drawings are exemplary, are merely used to explain the present disclosure, and cannot be construed as a limitation to the present disclosure.

In the description of the present disclosure, it should be understood that, the orientation or position relationship indicated by the terms "center," "longitudinal," "transverse," "length," "width," "thickness," "up", "down," "front," "rear," "left," "right," "vertical," "horizontal," "top," "bottom," "inner," "outer," "clockwise," "counterclockwise," "axial," "radial," "circumferential" and the like are based on the orientation or position relationship illustrated in the drawings. These terms are for convenience and simplification of description and do not indicate or imply that the device or element referred to must have a specific orientation, be constructed and operated in a specific orientation, so these terms shall not be construed to limit the present disclosure. In the description of the disclosure, "a plurality of" means at least two, such as two, three, etc., unless specified otherwise. In addition, the feature defined with "first" and "second" may comprise one or more of this feature. In the description of the present disclosure, "a plurality of" means two or more than two, unless specified otherwise.

In the present disclosure, it should be noted, unless specified or limited otherwise, the terms "mounted," "connected," "coupled" or the like are used broadly. The terms may indicate, for example, fixed connections, detachable connections, or integral connections, may also indicate mechanical or electrical connections, may also indicate direct connections or indirect connections via intermediate mediums, and may also indicate inner communications of two elements. The specific meanings of the terms in embodiments of the present disclosure may be understood by those skilled in the art according to particular circumstances.

An outdoor unit 100 for a central air conditioner according to embodiments of the present disclosure will be described below with reference to FIGS. 1-5.

As illustrated in FIGS. 1-5, the outdoor unit 100 for the central air conditioner according to embodiments of a first aspect of the present disclosure includes a unit body 1 and at least one panel 2.

For example, a compressor (not illustrated in drawings) and other components can be provided in the unit body 1. The panel 2 is arranged on the unit body 1 to open and close the unit body 1, and one end of the panel 2 is pivotally and detachably connected to the unit body 1 through a pivot structure 10. The pivot structure 10 includes a base 11 provided on the unit body 1 and a pivot seat 21 provided on the panel 2. A top of the base 11 is provided with a pivot shaft 111 spaced apart from the unit body 1 and extending upward, and the pivot seat 21 is provided with a pivot hole 2121 having an open bottom and configured to be detachably fitted with the pivot shaft 111. The base 11 is used to mount the pivot shaft 111 and connect the pivot shaft 111 to the unit body 1.

When the pivot shaft 111 is fitted in the pivot hole 2121, the panel 2 is pivotally mounted on the unit body 1 through the pivot structure 10. The pivot seat 21 can be turned to rotate around a central axis of the pivot shaft 111, such that the panel 2 can be turned relative to the unit body 1 and hence the panel 2 can open or close the unit body 1. When the pivot shaft 111 is separated from the pivot hole 2121, the panel 2 is separated from the unit body 1, and hence the panel 2 can be removed from the unit body 1.

As illustrated in FIG. 1, the panel 2 is usually in a state of closing the unit body 1. When it is necessary to repair or maintain the outdoor unit 100 of the central air conditioner, the panel 2 can be opened. At this time, the pivot seat 21 on the panel 2 rotates around the central axis of the pivot shaft 111 on the unit body 1, such that the panel 2 can be turned from a position illustrated in FIG. 1 to a position illustrated in FIG. 2. Therefore, compared with a traditional fixation method using bolts, the operation time of opening the panel 2 is greatly shortened, and the operation is convenient, thereby reducing the cost.

In the example of FIG. 1, one side of the unit body 1 (such as a front side in FIG. 1 and FIG. 2) can be configured to be open, and the panel 2 can be arranged on the above side of the unit body 1 to open and close the unit body 1.

Figure 3:
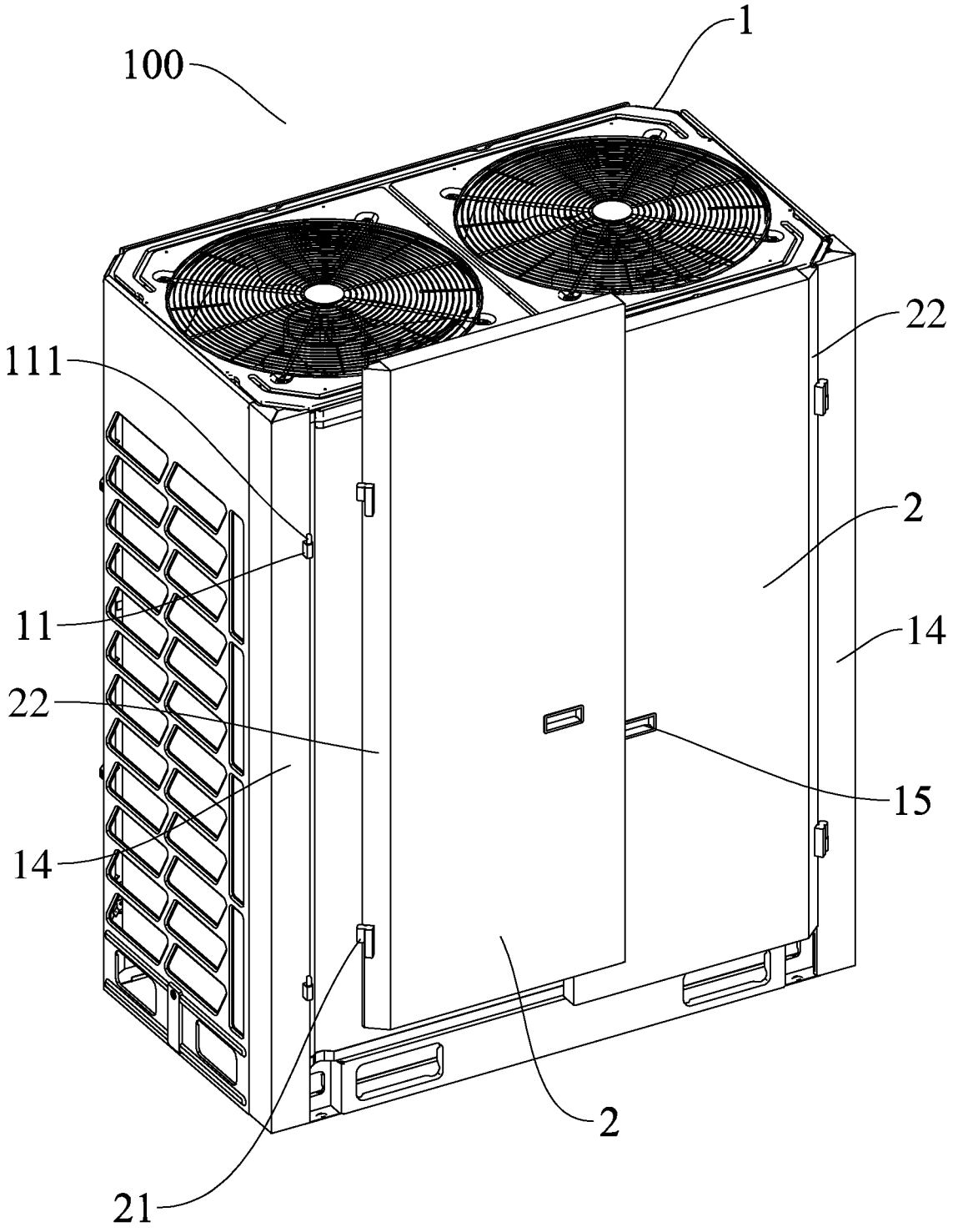
FIG. 3 is another perspective view of an outdoor unit for a central air conditioner according to an embodiment of the present disclosure, wherein a left panel is removed from a unit body.
Figure 4:
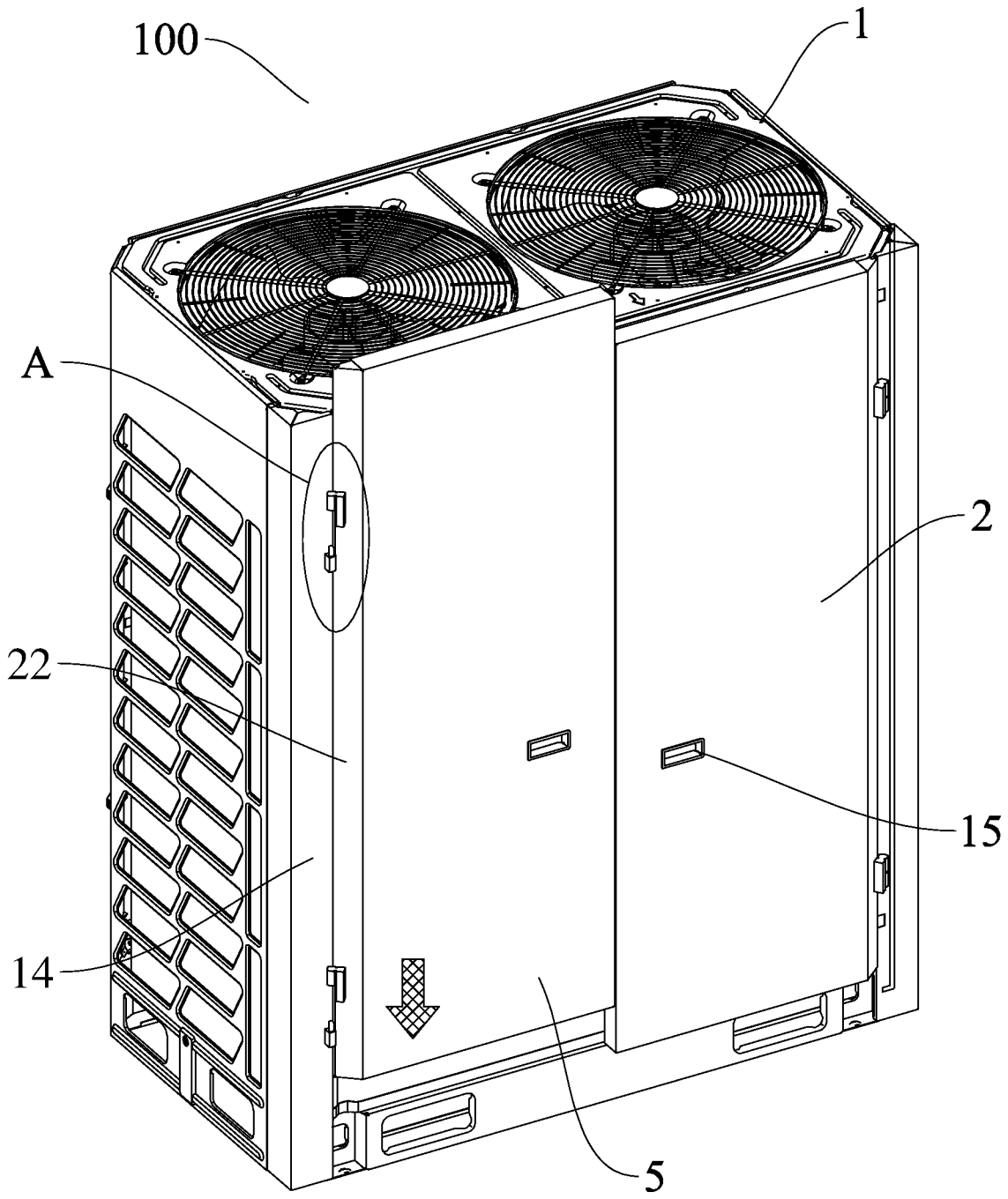
FIG. 4 is another perspective view of an outdoor unit for a central air conditioner according to an embodiment of the present disclosure.

When a space for opening the panel 2 is not sufficient and the panel cannot be fully opened, affecting the maintenance, the entire panel 2 can be lifted upward by providing the pivot shaft 111 extending upward and the pivot hole 2121 opened at the bottom. In such a case, the pivot seat 21 is gradually separated from the pivot shaft 111 from bottom to top. When the pivot shaft 111 is fully exposed from the pivot hole 2121, the entire the panel 2 can be removed (as illustrated in FIG. 3). After installation or maintenance, the way that the panel 2 is restored is in reverse to the above operation (as illustrated in FIG. 4), which is very convenient. Moreover, after the panel 2 is assembled on the unit body 1, due to its own gravity, the pivot shaft 111 can be well fitted in the pivot hole 2121 of the pivot seat 21, thus ensuring that the panel 2 can be opened and closed normally.

For the outdoor unit 100 according to the embodiments of the present disclosure, by pivotally and detachably connecting the panel 2 with the unit body 1 through the above pivot structure 10, the operation is convenient and time-saving when the outdoor unit 100 is repaired and maintained, thereby reducing the cost of manual maintenance or repair.

Figure 5:
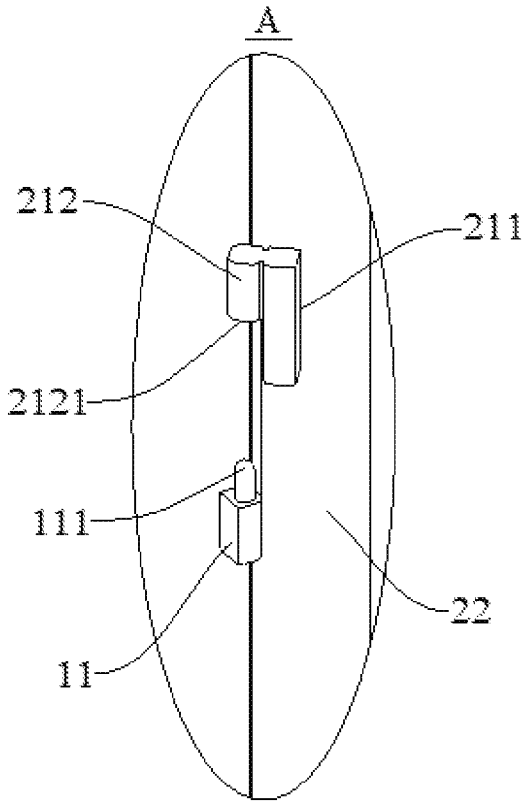
FIG. 5 is an enlarged view of part A circled in FIG. 4.
Figure 6:
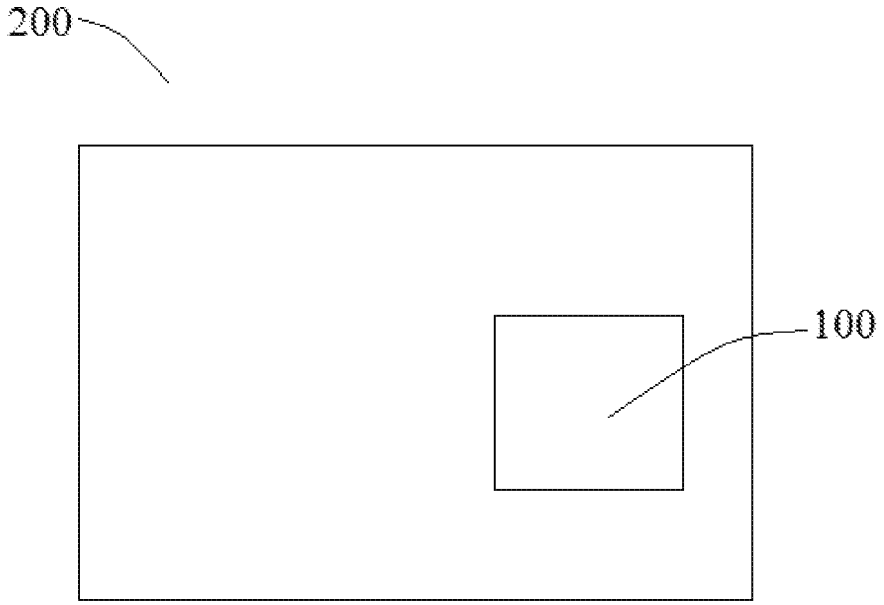
FIG. 6 is a structural view of a central air conditioner according to an embodiment of the present disclosure.

According to some embodiments of the present disclosure, referring to FIG. 4 and in combination with FIG. 5, the cross-sectional area of the base 11 is larger than that of the pivot shaft 111. Therefore, due to a relatively large size of the base 11, connection strength between the base 11 and the unit body 1 can be improved. Moreover, when the length of the pivot hole 2121 is equal to or greater than that of the pivot shaft 111, the base 11 can play a good role in supporting the pivot seat 21.

In some embodiments of the present disclosure, as illustrated in FIG. 5, the cross-sectional area of a top end of the pivot shaft 111 increases gradually from top to bottom. Thus, the top end of the pivot shaft 111 has a guiding effect on the installation of the pivot hole 2121, thereby improving the mounting efficiency of the panel 2.

According to some embodiments of the present disclosure, referring to FIG. 1 and in combination with FIG. 3 and FIG. 4, a front side of the unit body 1 is open, and the panel 2 is arranged at the front side of the unit body 1 to open and close the unit body 1. The unit body 1 includes two side walls 12 spaced apart from each other in a left-right direction and a rear wall 13 connected between rear ends of the two side walls 12. A front end of at least one of the two side walls 12 has an extended wall 14 that is parallel to the rear wall 13 and extends towards a center of the unit body 1. The base 11 is arranged on a front surface 140 of the extended wall and the base 11 is located on a side adjacent to the center of the unit body 1. A front surface 20 of the panel has a mounting surface 22 for arranging the pivot seat 21. The mounting surface 22 is located on an end of the panel 2 adjacent to the at least one of the two side walls 12, and the mounting surface 22 obliquely extends backward from the center of the unit body 1 to a side where the at least one of the two side walls 12 is located. Herein, it should be noted that the "front" direction can be understood as a direction facing the user, and the opposite direction is defined as the "rear" direction. Thus, by mounting the pivot seat 21 on the mounting surface 22 of the panel 2 in which the mounting surface 22 is obliquely arranged in a front-rear direction, an opening angle of the panel 2 with respect to the unit body 1 can be greater than 90° (for example, the opening angle may be 140°), thus further facilitating the maintenance and repair of the outdoor unit 100. It can be understood that a specific opening angle of the panel 2 relative to the unit body 1 can be determined according to an oblique angle of the mounting surface 22, so as to meet actual applications better. In addition, by arranging the base 11 on the extended wall 14 and close to the center of the unit body 1, the panel 2 can open and close the unit body 1 more smoothly, thus avoiding situations where the panel 2 interferes with the extended wall 14 during rotation and the panel cannot be opened or closed.

For example, as illustrated in FIG. 1, FIG. 3 and FIG. 4, the front surface 20 of the panel protrudes beyond the front surface 140 of the extended wall. The front surface of the panel 2, other than the mounting surface 22, and the front surface 140 of the extended wall are staggered in the front-rear direction, that is, they do not overlap. Thus, the appearance of the whole outdoor unit 100 can become more aesthetic.

According to some embodiments of the present disclosure, as illustrated in FIG. 5, the pivot seat 21 includes a pivot base 211 provided on the mounting surface 22 and a pivot body 212 which is provided on a side of the pivot base 211 adjacent to the extended wall 14 and is spaced from the panel 2. The pivot hole 2121 is formed in the pivot body 212, and a top surface of the pivot body 212 is flush with a top surface of the pivot base 211. The pivot body 212 is not in direct contact with the mounting surface 22 of the panel 2, but is indirectly connected with the mounting surface 22 of the panel 2 through the pivot base 211. Thus, the panel 2 can further open and close the unit body 1 more smoothly, thereby further avoiding the situations that the panel 2 interferes with the extended wall 14 in the process of rotation and the panel cannot be opened or closed. Moreover, by keeping the top surface of the pivot body 212 flush with the top surface of the pivot base 211, the top surface of the pivot body 212 is in the same horizontal plane as the top surface of the pivot base 211, thereby making the appearance of the entire pivot base 21 more aesthetic, and improving the aesthetics of the entire outdoor unit 100.

For example, referring to FIG. 5, the pivot hole 2121 only penetrates the bottom of the pivot body 212 of the pivot seat 21, and the pivot hole 2121 does not penetrate the top of the pivot body 212 of the pivot seat 21. Therefore, external dust is not easy to enter the pivot hole 2121, thus effectively ensuring the smoothness of opening and closing the unit body 1 by the panel 2 and extending the service life of the entire pivot structure 10.

According to some embodiments of the present disclosure, as illustrated in FIG. 1, FIG. 3 and FIG. 4, the panel 2 is pivotally connected with the unit body 1 through two pivot structures 10 spaced apart from each other in an up-down direction. Thus, one panel 2 is connected to the unit body 1 by providing the two pivot structures 10 in the up-down direction, which improves the reliability of the connection and pivotal movement between the panel 2 and the unit body 1 and at the same time saves the cost.

According to some embodiments of the present disclosure, the panel 2 is provided with a handle portion 15. The handle portion 15 is used to rotate the panel 2 or remove the panel 2 by hand. For example, as illustrated in FIGS. 1-4, the handle portion 15 can be formed by a part of a side surface of the panel 2 away from the center of the unit body 1 being recessed towards the center of the unit body 1 (for example, the handle portion 15 can be formed by a part of the front surface 20 of the panel being recessed backward). Certainly, the present disclosure is not limited thereto. The handle portion 15 can also be processed and molded separately (for example, injection molding). For example, the handle portion 15 can be processed into a cylindrical structure where one side is open and an edge of the open side has a flange extending outwards. The panel 2 can be formed with an opening running through the panel in a thickness direction. During the assembly, the handle portion 15 is mounted in the above opening from front to rear, and the flange of the handle portion 15 is in contact with and connected with the front surface 20 of the panel to play the role of connection and limitation. Thus, by providing the handle portion 15, when it is necessary to open or remove the panel 2, the operator can put one hand at the handle portion 15, thus greatly facilitating the operation.

According to some embodiments of the present disclosure, two panels are provided and arranged opposite to and spaced apart from each other. Thus, when the two panels 2 are fully opened, components inside the unit body 1 of the outdoor unit 100 can be better maintained or repaired.

The outdoor unit 100 according to the embodiments of the present disclosure overcomes the disadvantage that the panel 2 of the outdoor unit 100 has to be detached from the outdoor unit for the sake of maintenance, and the opening and closure of the panel 2 realized by pivotal movement greatly shortens the operation time of removing the panel 2.

During the maintenance, the operation can be implemented once the panel 2 is opened. If the space for opening the panel 2 is insufficient and the panel 2 cannot be opened completely, which will affect the maintenance, the panel 2 can be lifted by the handle portion 15, such that the pivot shaft 111 is separated from the pivot seat 21, and hence the panel 2 is completely detached from the outdoor unit 100.

When the panel 2 needs to be mounted back, the pivot seat 21 on the panel 2 is aligned with the pivot shaft 111 on the extended wall 14, and then the panel 2 is released, which highlights user-friendly design.

A central air conditioner 200 according to embodiments of a second aspect of the present disclosure includes the outdoor unit 100 according to embodiments of the first aspect of the present disclosure.

The central air conditioner 200 according to embodiments of the present disclosure can have enhanced overall performance by adopting the above outdoor unit 100.

Other components and operations of the central air conditioner 200 according to embodiments of the present disclosure are generally known by those skilled in the art and thus will not be described in detail herein.

Reference throughout this specification to terms "an embodiment," "some embodiments," "an example", "a specific example," or "some examples," means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Moreover, the particular features, structures, materials, or characteristics described may be combined in any suitable manner in one or more embodiments or examples.

Although embodiments of the present disclosure have been illustrated and described above, it should be understood by those skilled in the art that changes, modifications, alternatives, and variations may be made in the embodiments without departing from principles and purposes of the present disclosure. The scope of the present disclosure is limited by the claims and their equivalents.

The invention claimed is:

1. An outdoor unit for a central air conditioner, comprising:

a unit body;

at least one panel provided on the unit body to open and close the unit body, wherein an end of the panel is pivotally and detachably connected with the unit body through a pivot structure, the pivot structure comprises a base provided on the unit body and a pivot seat provided on the panel, a top of the base has a pivot shaft spaced apart from the unit body and extending upward, and the pivot seat is provided with a pivot hole having an open bottom and configured to be detachably fitted with the pivot shaft; and wherein a front side of the unit body is open, and the panel is arranged at the front side of the unit body; the unit body comprises two side walls spaced apart from each other in a left-right direction and a rear wall connected between rear ends of the two side walls; a front end of at least one of the two side walls has an extended wall that is parallel to the rear wall and extends towards a center of the unit body; the base is arranged on a front surface of the extended wall and is located on a side adjacent to the center of the unit body; a front surface of the panel has a mounting surface for arranging the pivot seat; the mounting surface is located on an end of the panel adjacent to the at least one of the two side walls, and the mounting surface obliquely extends backward from the center of the unit body to a side where the at least one of the two side walls is located.

2. The outdoor unit according to claim 1, wherein a cross-sectional area of the base is larger than a cross-sectional area of the pivot shaft.

3. The outdoor unit according to claim 1, wherein a cross-sectional area of a top end of the pivot shaft increases gradually from up to down.

4. The outdoor unit according to claim 1, wherein the front surface of the panel protrudes beyond the front surface of the extended wall.

5. The outdoor unit according to claim 1, wherein the pivot seat comprises a pivot base provided on the mounting surface and a pivot body which is provided on a side of the pivot base adjacent to the extended wall and which is spaced from the panel; a pivot hole is formed in the pivot body, and a top surface of the pivot body is flush with a top surface of the pivot base.

6. The outdoor unit according to claim 1, wherein the panel is pivotally connected with the unit body through two pivot structures spaced apart from each other in an up-down direction.

7. The outdoor unit according to claim 1, wherein the panel is provided with a handle portion.

8. The outdoor unit according to claim 7, wherein the handle portion is formed by a part of a side surface of the panel away from a center of the unit body being recessed towards the center of the unit body.

9. The outdoor unit according to claim 1, wherein two panels are provided and arranged opposite to and spaced apart from each other.

10. A central air conditioner comprising the outdoor unit according to claim 1.

11. The outdoor unit according to claim 2, wherein a cross-sectional area of a top end of the pivot shaft increases gradually from up to down.

12. The outdoor unit according to claim 2, wherein a front side of the unit body is open, and the panel is arranged at the front side of the unit body; the unit body comprises two side walls spaced apart from each other in a left-right direction and a rear wall connected between rear ends of the two side walls; a front end of at least one of the two side walls has an extended wall that is parallel to the rear wall and extends towards a center of the unit body; the base is arranged on a front surface of the extended wall and is located on a side adjacent to the center of the unit body; a front surface of the panel has a mounting surface for arranging the pivot seat; the mounting surface is located on an end of the panel adjacent to the at least one of the two side walls, and the mounting surface obliquely extends backward from the center of the unit body to a side where the at least one of the two side walls is located.

13. The outdoor unit according to claim 3, wherein a front side of the unit body is open, and the panel is arranged at the front side of the unit body; the unit body comprises two side walls spaced apart from each other in a left-right direction and a rear wall connected between rear ends of the two side walls; a front end of at least one of the two side walls has an extended wall that is parallel to the rear wall and extends towards a center of the unit body; the base is arranged on a front surface of the extended wall and is located on a side adjacent to the center of the unit body; a front surface of the panel has a mounting surface for arranging the pivot seat; the mounting surface is located on an end of the panel adjacent to the at least one of the two side walls, and the mounting surface obliquely extends backward from the center of the unit body to a side where the at least one of the two side walls is located.

14. The outdoor unit according to claim 4, wherein the pivot seat comprises a pivot base provided on the mounting surface and a pivot body which is provided on a side of the pivot base adjacent to the extended wall and which is spaced from the panel; a pivot hole is formed in the pivot body, and a top surface of the pivot body is flush with a top surface of the pivot base.

15. The outdoor unit according to claim 2, wherein the panel is pivotally connected with the unit body through two pivot structures spaced apart from each other in an up-down direction.

16. The outdoor unit according to claim 2, wherein the panel is provided with a handle portion.

17. The outdoor unit according to claim 2, wherein two panels are provided and arranged opposite to and spaced apart from each other.

18. A central air conditioner comprising the outdoor unit according to claim 2.

19. A central air conditioner comprising the outdoor unit according to claim 3.

* * * * *